United States Patent [19]

Kline

[11] 4,174,072

[45] Nov. 13, 1979

[54] OVERLOAD PROTECTIVE DEVICE

[75] Inventor: Charles M. Kline, Reinholds, Pa.

[73] Assignee: Sperry Rand Corporation, New Holland, Pa.

[21] Appl. No.: 889,310

[22] Filed: Mar. 23, 1978

[51] Int. Cl.[2] ..... B02C 25/00

[52] U.S. Cl. ..... 241/35; 192/105 CF; 241/101 B; 241/101.7; 241/186 A; 241/186.2

[58] Field of Search ..... 192/105 CF, 103 B; 241/34, 35, 101.6, 186.2, 101.2, 185 R, 186 R, 32, 186 A, 101 B; 366/603

[56] References Cited

U.S. PATENT DOCUMENTS

| | | | |
|---|---|---|---|
| 1,842,835 | 1/1932 | Miller | 192/105 CF |
| 2,753,122 | 7/1956 | Nauta | 241/35 |
| 3,269,527 | 8/1966 | Denham | 241/35 X |
| 3,999,674 | 12/1976 | Meitl | 241/35 X |
| 4,026,528 | 5/1977 | Kline et al. | 241/101.2 X |

*Primary Examiner*—Mark Rosenbaum
*Attorney, Agent, or Firm*—Ralph D'Alessandro; Frank A. Seemar; John B. Mitchell

[57] ABSTRACT

In a crop feed grinding and mixing apparatus having a mixing means mounted to a mobile frame, a grinding means fixed to the frame, material transfer means extending at least between the grinding means and the mixing means, material infeed means in material flow communication with the grinding means and drive means including a rotatable shaft operably connected to the mixing, grinding, material infeed and material transfer means, there is provided a speed responsive overload protective device mounted to the rotatable shaft so that when the drive means is slowed in operation below a predetermined speed by excessive crop feed accumulation in the grinding means the protective device automatically disengages the material infeed means from the drive means. The disengagement of the material infeed means permits the grinding means to continue to operate without any additional crop feed being delivered thereto, until the rotatable shaft returns to the predetermined speed at which time the protective device will automatically reengage the infeed material means to permit the flow of crop feed to recommence.

14 Claims, 4 Drawing Figures

OVERLOAD PROTECTIVE DEVICE

BACKGROUND OF THE INVENTION

This invention relates generally to crop feed handling apparatus and more particularly to a machine for grinding and mixing crop feed utilizing a speed responsive, positively engaging overload protective device mounted to the drive means to protect and prevent damage from occurring to the material infeed means by preventing plugging or jamming in the hammermill. Crop feed grinding and mixing machines, commonly called grinder-mixers, are normally provided with a mobile frame and a generally vertical extending mixing tank mounted on the frame. A hammermill is carried on the frame and provided with a hopper to receive feed material. The hammermill is used to grind desired types of crop feed materials before these materials are conveyed to the mixing tank as an additive to the feed mixture. The hammermill, of necessity, must be able to handle many different types of crop feed materials.

The hammermill is driven through a series of shafts and belted sheaves or sprockets from the power take-off of a tractor. Any feed material, when deposited in sufficient quantities into the hammermill, under varying moisture content conditions can create an excessive load that will cause the hammermill to jam or, at least, slug and decrease in speed. Certain crops, such as hay, naturally will cause a greater load strain on the hammermill as crop accumulation occurs. Crops with high moisture content will have a similar effect. Under such conditions if the infeed mechanism, normally in the form of an infeed auger, does not decrease or stop entirely the flow of crop feed material to the hammermill, the hammermill will jam and potentially cause serious damage to the grinder-mixer and the tractor.

Recently grinder-mixers of the type shown in U.S. Pat. No. 4,026,528, issued May 31, 1977 to Kline et al have enjoyed increasing popularity in the agricultural industry. This increased popularity has resulted in increasing numbers of grinder-mixers being used and, coupled with the now universally accepted fact that higher nutrient feeds produce more profitable and marketably attractive livestock, has caused attention to be focused on improved ways to prevent damage to the grinder-mixer drive means in the event of jamming of the hammermill, to avoid such costly jamming and to provide an overload protective device whose operating efficiency is not susceptible to operating or weather conditions.

Prior grinder-mixers utilized a friction clutch type of overload protective device in a hammermill of the type generally illustrated by U.S. Pat. No. 3,510,075, issued May 5, 1970 to Mann et al and assigned to the assignee of the present invention. Such overload protective devices were particularly susceptible to the weather conditions and the conditions under which the grinder-mixers routinely were operated. Since the overload protective devices were friction type clutches, dust and dirt would accummulate on the clamping device, usually in the form of a clamping screw, and would resist its clamping and unclamping movement. This would require the shaft-mounted clutch to achieve greater rotational speed to cause the pivotable friction arm to pivot radially outwardly and in turn cause the self-clamping frictional surfaces to effectively engage. The friction clutch would engage the infeed mechanism to transfer crop feed material to the hammermill. More significantly, these friction type clutches would slip when operated in their normal working environments in wet, muddy, icy or the generally sloppy conditions frequently found on farms or feedlots. These factors, plus the inherent disadvantages of a friction clutch system, such as wear and sensitivity, required that frequent readjustments be made to the friction clutches. Additionally, the hypersensitivity of these types of clutches all too frequently resulted in the clutch being either adjusted too tightly so that it would not disengage upon jamming or overloading or not being adjusted tightly enough so that the drive means slipped and crop feed material was transported to the hammermill at less than the optimum rate. The friction contact surfaces also required periodic and costly replacement during normal operating conditions. Lastly, these types of overload protective clutches were extremely costly to manufacture because of the high cost friction design material required.

The foregoing problems are solved in the design of the machine comprising the present invention by providing a positively engaging, functionally nonfriction dependent centrifugal clutch that automatically disengages the material infeed means from the drive means whenever excessive crop feed accumulation occurs in the grinding means and causes the drive means to be slowed in operation below a predetermined speed. The grinding means, in the form of a hammermill, continues to operate without any additional crop feed being delivered to it until the drive means returns to the predetermined speed, at which time the material infeed means is automatically reengaged by the positively engaging functionally nonfriction dependent centrifugal clutch to permit the flow of crop feed to recommence.

SUMMARY OF THE INVENTION

It is the principal object of the present invention to provide an improved grinder-mixer drive means that will automatically disengage the material infeed means whenever the hammermill is overloaded in operation and jamming or damage to the drive means is imminent.

It is another object of the present invention to provide an improved grinder-mixer drive means that will permit the hammermill to continue to operate after the material infeed means has been disengaged in order to continue to process the crop feed accumulated therein.

It is a further object of the invention to provide an improved grinder-mixer drive means that will automatically reengage the material infeed means without slippage once the hammermill has been cleared of excessive crop feed accumulation and the drive means has returned to at least the required predetermined threshold speed.

It is still another object of the present invention to provide an improved grinder-mixer drive means that has a positively engaging speed responsive overload protective device mounted thereto that is simple and reliable in operation, inexpensive to manufacture and which requires a minimal number of adjustments to maintain optimum operating efficiency.

It is a further object of the present invention to provide an improved grinder-mixer drive means that has an overload protective device that is substantially unaffected by weather conditions or operating conditions.

These and other objects and advantages are obtained by providing a speed responsive overload protective device in the form of a positively engaging, functionally nonfriction dependent clutch mounted to the drive means in a crop feed grinder-mixer so that when the drive means is slowed in operation below a predetermined speed by excessive crop feed accumulation in the grinding means the centrifugal clutch automatically disengages the material infeed means from the drive means in order to permit the grinding means to continue to operate without any additional crop feed being delivered thereto. Upon the return of the drive means to the predetermined speed, the centrifugal clutch automatically permits the material infeed means to be reengaged and the flow of crop feed material to recommence.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
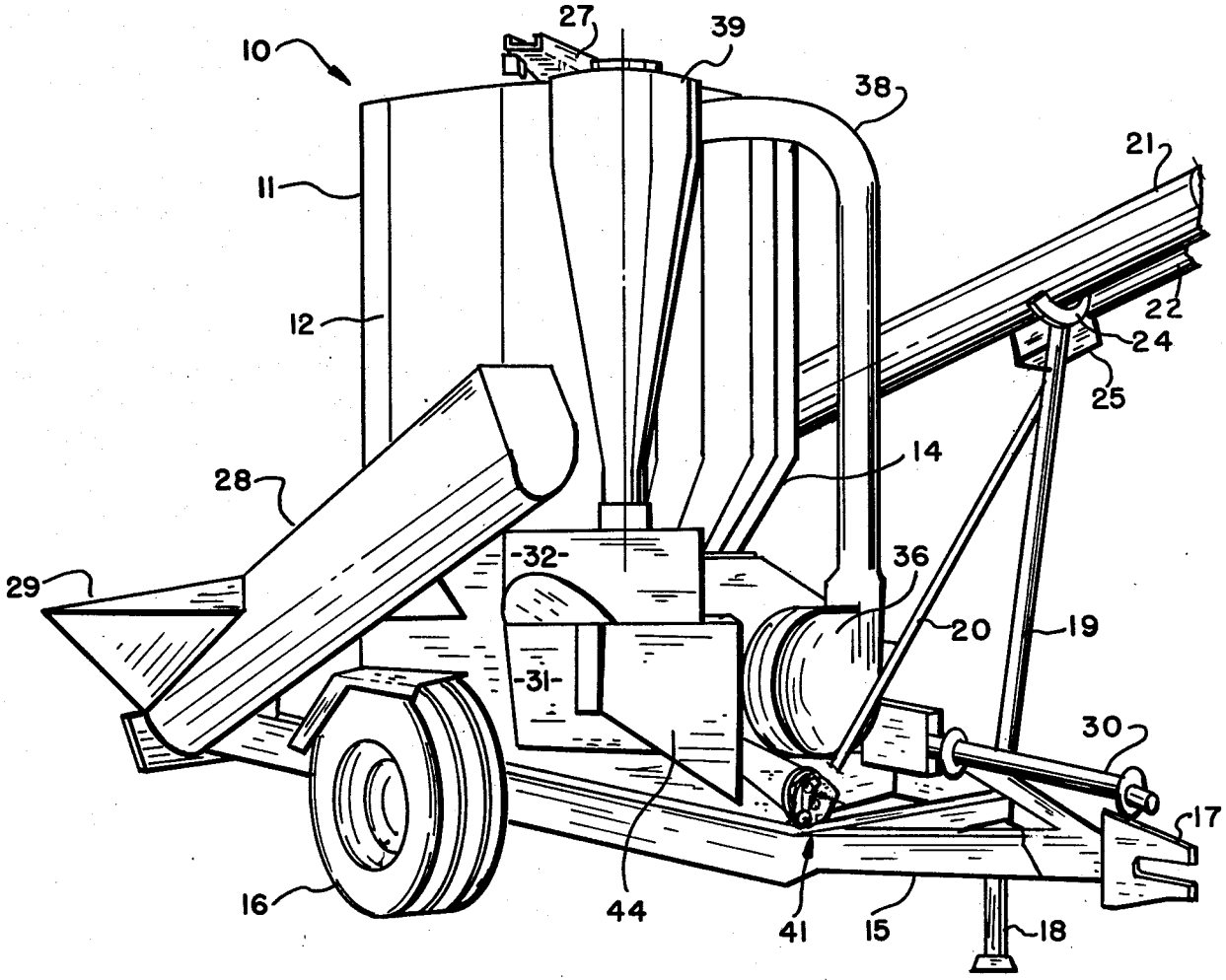
FIG. 1 is a side perspective view of a crop feed grinding and mixing apparatus generally showing the locations of the operational components.

FIG. 1 depicts a general representation of the grinder-mixer 10 having an upright, generally vertical mixing container 11. The mixing container 11 has a cylindrical upper section 12 and a conically downwardly converging lower section 14. The mixing container 11 is mounted to a frame, indicated generally by the numeral 15, which is in turn mounted to a pair of wheels, only one of which is shown, the frame 15 is connectable to a towing vehicle, such as a tractor, at a hitch 17. The frame 15 has a retractable jack stand 18 for support of the frame when the grinder-mixer is not attached to the towing vehicle. The frame 15 also has support members 19 and 20 mounted thereon to provide support to the fold-back unloading augers (not shown), housed within auger casings 21 and 22. The support members 19 and 20 have brackets 24 and 25 respectively, in which auger casings 21 and 22 respectively are carried when not in operation. Mixing container 11 also has a support member 27 across its top to which a winch and pulley system (not shown) can be attached for the crop material infeed auger 26, shown in FIG. 4, and housing 28. Infeed auger housing 28 has a loading auger hopper 29 attached to its lowermost end to increase the flow capacity of the infeed auger 26 when small grain is being ground.

The grinder-mixer has a power take-off shaft 30 connectable with the power take-off of the tractor to provide the rotary power that is necessary to drive the operational components of the grinder mixer. The power take-off shaft 30, through a series of belted sheaves, sprockets and gears best shown in FIG. 4, drives a hammermill 31 via hammermill shaft 33. The hammermill 31 is located directly below the crop material infeed housing 28 and its infeed auger 26. The hammermill 31 is fastened to the frame 15 and is of a conventional grinder-mixer type which functions to initially grind feed material prior to the feed material being transferred to the mixing container 11. The hammermill 31 is not shown in detail here, but is generally of the type described and shown in U.S. Pat. No. 3,510,075 to Mann et al, issued May 5, 1970. The crop feed material is deposited from the material infeed auger 26, encased by the crop material infeed housing 28, into a hammermill hopper 32 from which it is fed into the hammermill 31 for grinding.

Figure 4:
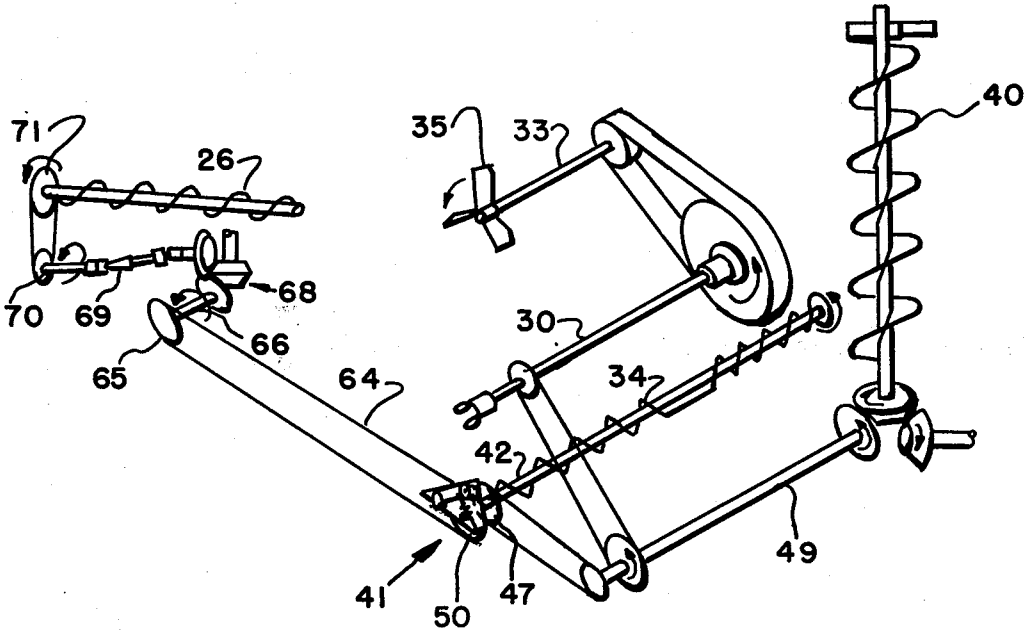
FIG. 4 is a diagrammatic illustration of a portion of the drive means of a crop feed grinding and mixing apparatus.

The ground crop feed material from the hammermill 31 is fed into the mixing container 11 by the transfer auger 34, shown diagrammatically in FIG. 4. The portion of the ground crop feed material which is too fine to gravitate into transfer auger 34 is captured in an air stream produced by fan 35, encased in a housing 36, as shown in FIG. 1, and conveyed upwardly through a vertical transfer pipe 38 into a cyclone-type dust collector 39 that functions in a conventional manner to centrifugally separate feed material from the air. Crop feed material separated by the dust collector 39 is returned by gravitation into the transfer auger 34 of FIG. 4 via a return pipe (not shown) extending vertically along one side of the cylindrical section of the mixing container 11.

Since supplemental feed concentrates are commonly introduced to the ground material being mixed in the tank during normal operation, a feed concentrate hopper (not shown) is provided, usually at the rear of the machine. The feed supplements, such as high protein additives, minerals, or salt, are conveyed via an auxiliary transfer auger (not shown) or some other suitable means into the mixing container 11 in a manner similar to the way in which the crop feed material processed by the hammermill 31 is transferred by transfer auger 34.

Once the feed material and the feed supplements are conveyed to the mixing container 11 vertical auger 40, diagrammatically shown in FIG. 4, serves to mix the crop material in a manner shown and described in detail in U.S. Pat. No. 4,026,528, issued May 31, 1977 to Kline et al, assigned to the assignee of the instant invention. When mixing is complete the feed mix is unloaded from the mixing container 11 by means of the unloading auger (not shown) encased in auger casings 21 and 22, shown and described in detail in U.S. Pat. No. 3,638,816 issued Feb. 1, 1972 to Mann and assigned to the assignee of the present invention.

To protect the hammermill 31 and the drive means of the grinder-mixer 10 during operation a speed responsive centrifugal clutch 41 is mounted about the transfer auger shaft 42, as shown in FIGS. 1 and 4. Since the transfer auger shaft 42 is connected to the power take-off shaft 30 through a series of belted sheaves and sprockets masked behind shield 44 of FIG. 1, when the hammermill 31 experiences an overload and rotatably decreases in speed the speed responsive centrifugal clutch 41 is automatically disengaged in response to the shaft's decreasing below a predetermined threshhold speed.

Figure 2:
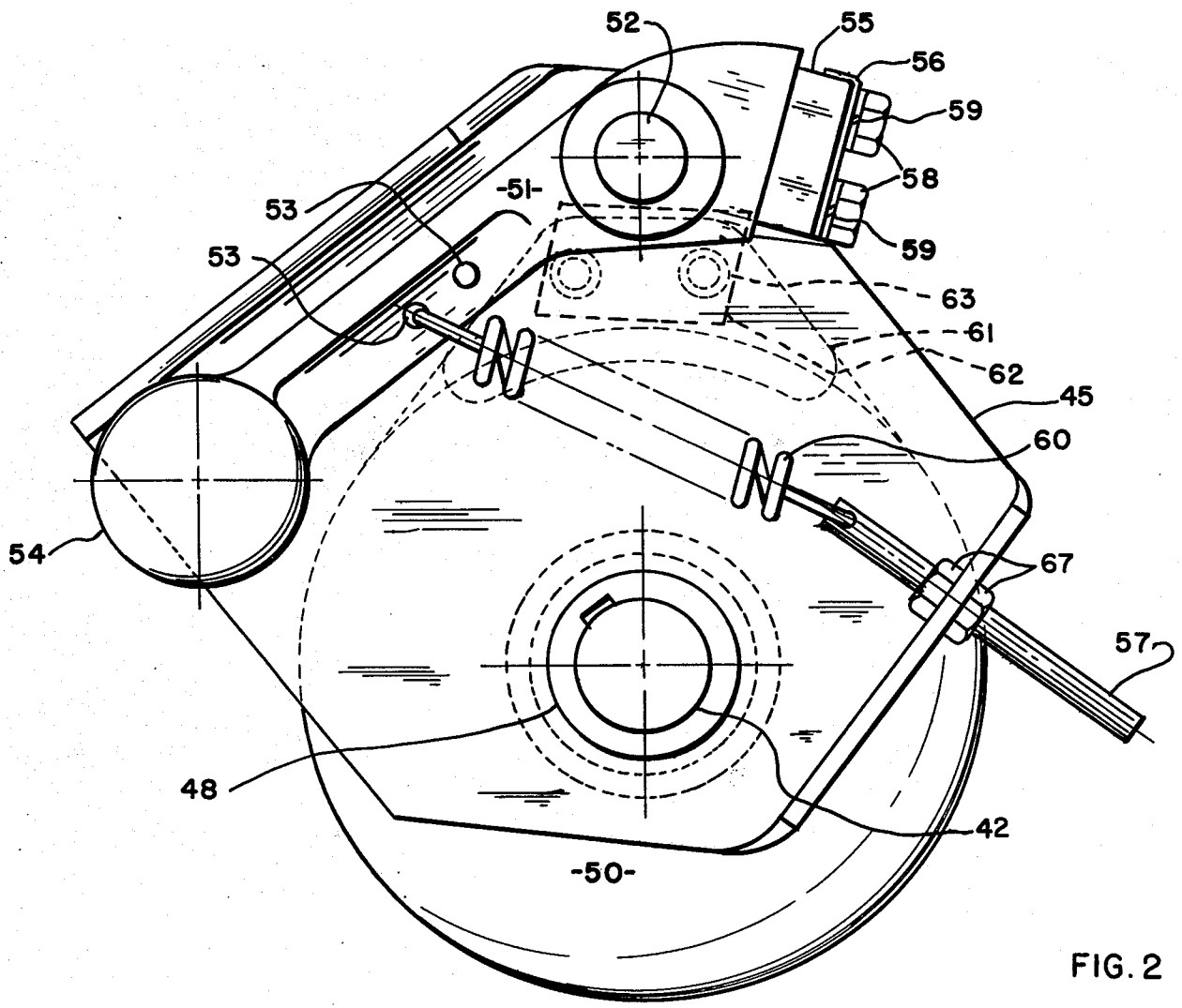
FIG. 2 is a front elevation of the centrifugal clutch which comprises the speed responsive overload protective device.
Figure 3:
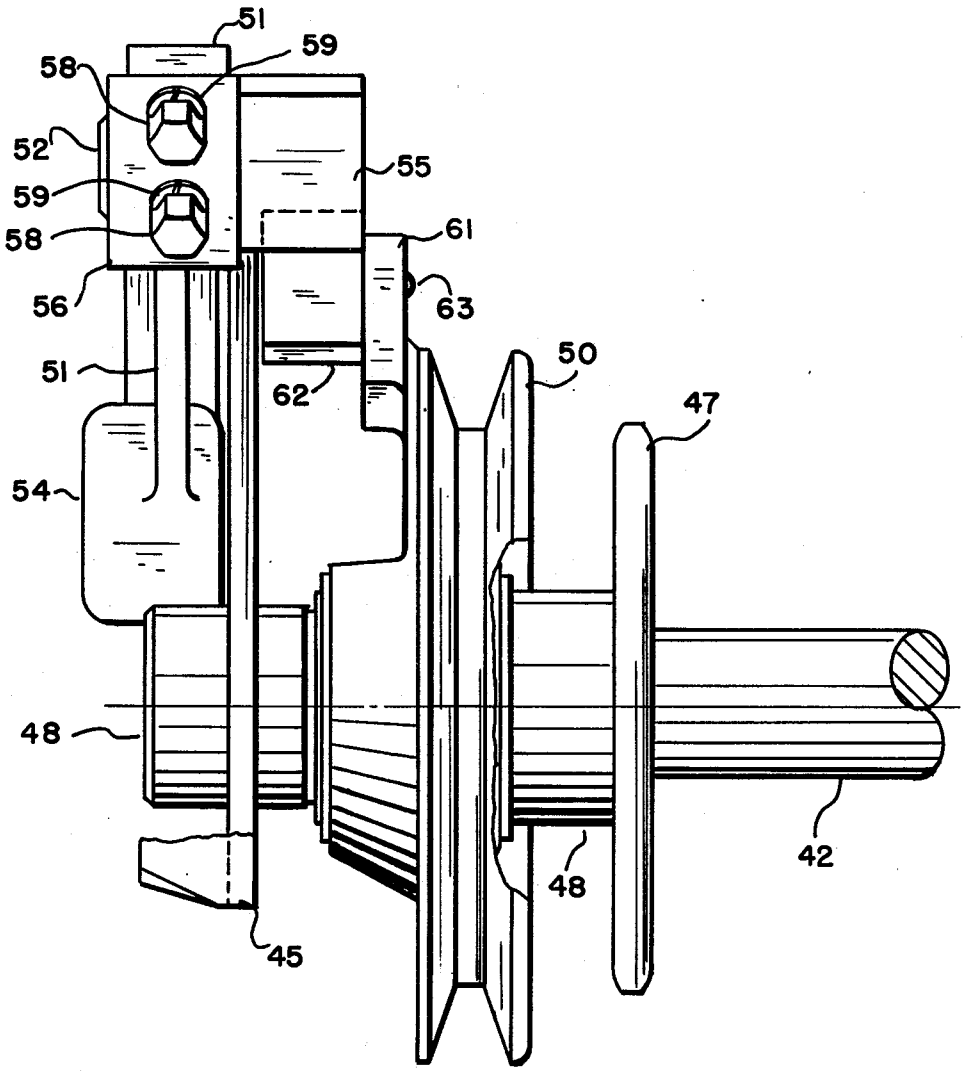
FIG. 3 is a side elevation of the centrifugal clutch.

The centrifugal clutch 41 is shown in detail in FIGS. 2 and 3. Plate 45 and drive sprocket 47 are mounted on collar 48, which is keyed to the transfer auger shaft 42 so that the plate 45 rotates with the collar 48 and the transfer auger shaft 42 as the drive sprocket 47 is rotatably driven by the gearbox drive shaft 49 of FIG. 4. The belted sheave 50 is rotatably mounted on the collar 48.

Pivot arm 51 is pivotally mounted on plate 45 by pivot pin 52. One end of pivot arm 51 contains an integral weight 54, while the other end contains a locking tab 55. Locking tab 55 has a bracing plate 56, shown in FIG. 2, which allows locking nuts 58 and washers 59 to secure the locking tab 55 to the pivot arm 51. Spring 60 biases pivot arm 51 towards a retracted or disengaged position. Spring 60 is fastened to pivot arm 51 through one of tensioning apertures 53. The opposing end of spring 60 is removably fastened to fastening pin 57 which is secured to plate 45 by lock nuts 67.

Belted sheave 50 has a support 61 fastened in appropriate manner, such as welding, to its outer periphery. Block 62 is attached to support 61 by fasteners 63 so that block 62 rotates with the sheave 50 as the sheave 50 is rotated about collar 48. As shown in FIG. 4, sheave 50 is used to drive the infeed auger 26 by means of a drive belt 64 and driven sheave 65, shaft 66, spur gears indicated generally by the numeral 68, a clutch 69 and belted sheaves 70 and 71, finally connecting to the infeed auger 26. It should be understood that any of the power transfer means described as belted sheaves could as easily be employed as chain driven sprockets.

In operation, crop feed material is loaded into loading auger hopper 29 and sent to an infeed auger 26 where it is conveyed to hammermill hopper 32. The crop feed material is fed into hammermill 31 where it is ground and then transported by transfer auger 34 to the mixing container 11 for final formulation into an appropriate crop feed material mixture. Should the hammermill 31 become overloaded due to excessive crop feed material accumulation or other jamming means the transfer auger 34 will be slowed in its rotational speed until the overloading is removed.

The positively engaging, frictionless speed responsive overload protective device, centrifugal clutch 41, is mounted about transfer auger shaft 42, and operates as described below.

Rotation of the drive sprocket 47 rotates the collar 48 and the plate 45 about the shaft 42. The pivot arm 51 rotates with the plate 45. As the rotational speed of the plate 45 increases, the pivot arm 51 pivots about the pivot pin 52 in a clockwise direction as viewed in FIG. 2, causing the weight end 54 of the arm 51 to move outwardly away from shaft 42 due to centrifugal force. The other end of pivot arm 51 with locking tab 55 moves inwardly toward the shaft 42. As the locking tab 55 moves inwardly it drivingly engages the block 62 on the sheave 50, thereby drivingly rotating the sheave 50. The biasing spring 60 establishes a predetermined force which counteracts the centrifugal force. Thus, as the centrifugal force exceeds the predetermined spring force, due to the rotational speed of the plate 45, the pivot arm 51 pivots causing the locking tab 55 to positively move into engagement with the block 62. As the rotational speed decreases, the biasing spring 62 forces the pivot arm 51 to pivot in the opposite direction, causing the locking tab 55 to disengage the block 62, thereby disengaging the sheave 50. Upon disengagement from belted sheave 50 the transfer of power to loading auger 26 ceases and crop feed material is no longer delivered to the hammermill 31. Hammermill 31, however, continues to operate, thereby working to reduce the overload condition and gradually increase the rotational speed of the transfer auger shaft 42. Upon removal of the overload condition to the hammermill 31, the speed of the transfer auger 42, through the drive connections best shown in FIG. 4, is gradually increased until it passes the predetermined speed. This allows centrifugal clutch 41 to automatically have locking tab 55 pivot inwardly to engage block 62, thereby automatically reestablishing the drive line to infeed auger 26. Upon reengagement of centrifugal clutch 41, infeed auger 26 recommences to transfer crop feed material to the hammermill 31 for grinding and ultimate inclusion within the mixing container 11.

While the preferred structure in which the principles of the present invention have been incorporated is shown and described above, it it to be understood that the invention is not to be limited to the particular details thus presented, but, in fact widely different means may be employed in the practice of broader aspects of this invention. The scope of the appended claims is intended to encompass all obvious changes in the details, materials and arrangements of parts which will occur to one of skill in the art upon the reading of this disclosure.

Having thus described the invention, what is claimed is:

1. In a crop feed grinding and mixing apparatus having a mixing means mounted to a mobile frame, a grinding means fixed to the frame, material transfer means extending at least between the grinding means and the mixing means, material infeed means in material flow communication with the grinding means and drive means including a first rotatable shaft and a second rotatable shaft, the first shaft being operably connected to the second shaft and the mixing, grinding, material infeed and material transfer means, the improvement in the drive means comprising:

a positively engaging, functionally nonfriction dependent speed responsive overload protective device mounted to the second rotatable shaft including a power transfer means with a block affixed thereto and a pivotable arm rotatably mounted adjacent the power transfer means having a first weighted end and a second driving end with a tab affixed thereto for mated driving engagement with the block to thereby drive the material infeed means so that when the first rotatable shaft is slowed in operation below a predetermined speed by excessive crop feed accumulation in the grinding means the protective device automatically disengages the material infeed means from the drive means in order to permit the grinding means to continue to operate without any additional crop feed being delivered thereto until the first rotatable shaft returns to the predetermined speed, thereby automatically causing the tab to return to a condition of driving engagement with the block reengaging the material infeed means to permit the flow of crop feed material to recommence.

2. The apparatus according to claim 1 wherein the power transfer means comprises a belted sheave.

3. The apparatus according to claim 1 wherein the power transfer means comprises a sprocket.

4. The apparatus according to claims 2 or 3, wherein the pivotable arm of the protective device is biased so that the predetermined speed of the first rotatable shaft must be sufficient to drive the second rotatable shaft at a speed to cause the weighted end of the pivotable arm to pivot outwardly from the second rotatable shaft and the driving end correspondingly to pivot inwardly to overcome the opposing biasing force to permit the tab to engage the block to drive the material infeed means.

5. The apparatus according to claim 4, wherein the grinding means comprises a hammermill and the mixing means comprises a vertical auger with spiral flighting mounted within an upright generally cylindrical mixing tank.

6. The apparatus according to claim 5, wherein the material infeed means comprises an auger with horizontal spiral flighting to deliver crop feed material from a predetermined collection point to the hammermill.

7. The apparatus according to claim 5, wherein the infeed means comprises a powered bale feeder for feeding a generally rectangular shaped package of forage material from a predetermined receiving point to the hammermill.

8. In a crop feed grinding and mixing apparatus comprising:

(a) a mobile frame;

(b) a generally cylindrical mixing container mounted to the mobile frame;

(c) drive means mounted to the frame and including at least a first rotatable shaft and a second rotatable shaft operably connected to the first rotatable shaft;

(d) power transfer means mounted about the second rotatable shaft and having a block affixed thereto;

(e) grinding means mounted to the frame and operably connected to the first rotatable shaft;

(f) crop material infeed means to transport crop material to the grinding means, the material infeed means further being operably connected to the second rotatable shaft, (g) mixing means mounted within the mixing container, (h) transfer means in material flow communication with the mixing means;

(i) a positively engaging, functionally nonfriction dependent speed responsive overload protective device having a pivotable arm with a first weighted end and a second driving end, the second driving end having a locking tab affixed thereto for mated driving engagement with the block, the device being mounted about the second rotatable shaft such that when the first rotatable shaft is slowed in operation below a predetermined speed by excessive crop feed accumulation in the grinding means the first weighted end pivots inwardly towards the second rotatable shaft and the locking tab correspondingly pivots outwardly to remove the locking tab from driving engagement with the block and automatically engage the material infeed means from the drive means in order to permit the grinding means to continue to operate without any additional crop feed material being delivered thereto until the first rotatable shaft returns to the predetermined speed, thereby causing the locking tab to drivingly reengage the block and automatically reengage the material infeed means to permit the flow of crop feed material to recommence.

9. The apparatus according to claim 8 wherein the power transfer means comprises a belted sheave.

10. The apparatus according to claim 8 wherein the power transfer means comprises a sprocket.

11. The apparatus according to claims 9 or 10 wherein the pivotable arm is biased so that the predetermined speed of the first rotatable shaft must be sufficient to cause the first weighted end of the pivotable arm to overcome the opposing biasing force to permit the locking tab to drivingly engage, the block and drive the material infeed means.

12. The apparatus according to claim 11 wherein the grinding means comprises a hammermill and the mixing means comprises a vertical auger with spiral flighting mounted within the mixing container.

13. The apparatus according to claim 12 wherein the material infeed means comprises an auger with generally horizontal spiral flighting.

14. The apparatus according to claim 12, wherein the material infeed means comprises a powered bale feeder for feeding a generally rectangular shaped package of forage material from a predetermined receiving point to the grinding means.

* * * * *